United States Patent [19]

Hargis

[11] Patent Number: 4,662,652

[45] Date of Patent: May 5, 1987

[54] FOUR SIDED FLASH CARD

[76] Inventor: L. Calvin Hargis, 40 Maple Ave., Warwick, N.Y. 10990

[21] Appl. No.: 756,661

[22] Filed: Jul. 19, 1985

[51] Int. Cl.[4] ..... B42D 15/00; G09F 7/00; G09F 19/00

[52] U.S. Cl. ..... 283/74; 283/900; 40/371

[58] Field of Search ..... 283/1 A, 1 R, 74, 79, 283/81, 900; 40/371; D19/1

[56] References Cited

U.S. PATENT DOCUMENTS 4,156,539 5/1979 Davidson et al. ..... 283/900
4,239,261 12/1980 Richardson ..... 283/74
4,506,914 3/1985 Gobeli ..... 283/74

*Primary Examiner*—Paul A. Bell

*Assistant Examiner*—Paul M. Heyrana, Sr.

[57] ABSTRACT

Permanent identification of patient information including facility where x-rays are performed, the facilities' address, the patients' name, the number of the x-ray and the date of the x-ray, are imprinted on x-ray film using a flash marking system and a special four-sided flash card. The four-sided flash card is so designed that a single card may be used to imprint information regarding four patients. The information written on the flash card with a dark graphite pencil is thus transferred to the x-ray film by means of a light flash which passes thru the card in the area imprinted with patient information and on to the unexposed x-ray film which overlays the imprinted information on the card. Thus the x-ray film is permanently inscribed with the foregoing information.

6 Claims, 2 Drawing Figures

FOUR SIDED FLASH CARD

BACKGROUND OF THE INVENTION

1. Field of the Invention

The invention relates to a system, apparatus and method used to record certain information on an area of unexposed x-ray film and thereby permanently marking the x-ray. More specifically the invention relates to a card which is so devised that certain patient information as well as information regarding the facility and site where x-rays were taken can be recorded onto the card.

II. Description of the Prior Art

Flash marking systems known to the art normally insure the ability of the doctor or technician to permanantly flash imprint information onto an area of unexposed x-ray film. The flash marking apparatus used to imprint x-ray film has been in use for some time and is an improvement on the older system of using lead letters superimposed on the x-ray to imprint the information. An index card, whereupon has been written the x-ray facility of doctor's name, the x-ray facilities' address as well as the patient's name, the serial number of the x-ray and the date of the x-rays is used for the process. The card is inserted into the flash mechanism so that the box holding the patient information is directly over the window area of the flasher. Light is passed thru the card and onto the x-ray film in an area of the film that has been protected from radiation in a 'blocked area'. Imprinting the information on the x-rays by use of a flash marking system, was found to be much quicker and overall less expensive due to the reduction of man hours required. However, the traditional index card that has been used in the flashing of x-ray film has been limited in that the card is imprinted on only one side, therefore one entire card was used for each patient. Thus in accordance with the present invention it is an object to provide a new and improved method for multiple use of the imprinting card for imprinting on x-rays. In addition to the increased information that each card will hold there is an eccentrically punched hole in each card which allows for the easy stacking and storing of multiple cards. It is moreover a specific object of the present invention to provide for a simplified lower cost card that will imprint multiple x-rays and will be easy to handle and store.

SUMMARY OF THE INVENTION

In characterizing the card related to as the Four Sided Flash Card, it is a card imprinted on each of its four sides with duplicate information concerning a facility and its address, or a doctor and his address along with the patient name, number of the x-ray in a series and date. This type of information is contained on each side and is duplicated on each of the four sides. Because of the four sided arrangement of the card, four different groups of x-rays can be imprinted for four different patients and after the imprintation because of the eccentric hole the cars may be stacked on upon another in serial numerical order and easily boxed. The method of stacking will be facilitated if the doctor or technician can stack the card on a rod which projects perpendicularly from a nearbey wall. In the embodiment of the card contained herein, entitled FIG. 2, the repeating nature of the data and the eccentric hole are clearly visible.

DETAILED DESCRIPTION OF THE INVENTION

Figure 1:
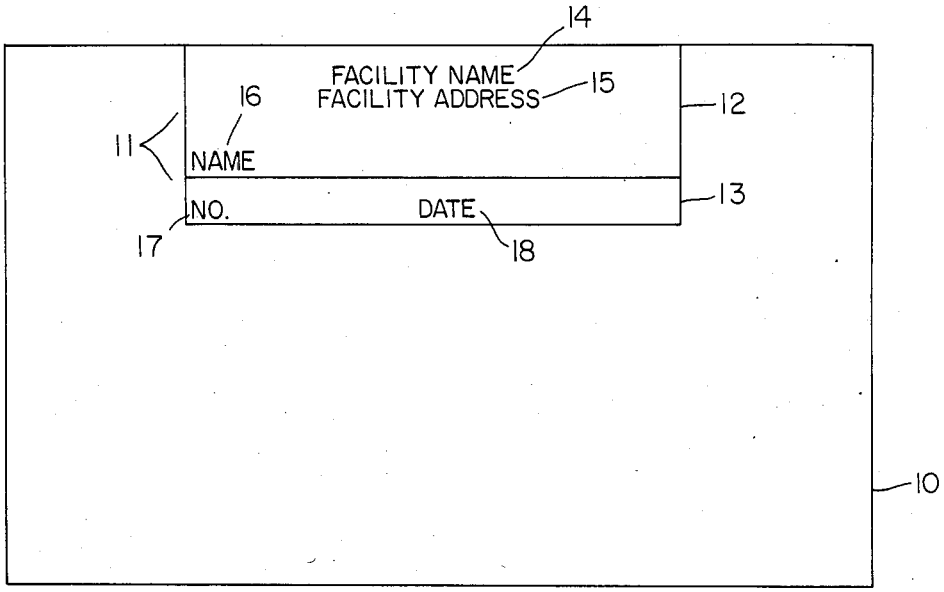
FIG. 1 is a full sized view of a traditional x-ray flash marking card which embodies the flash marking card as it has been known.
Figure 2:
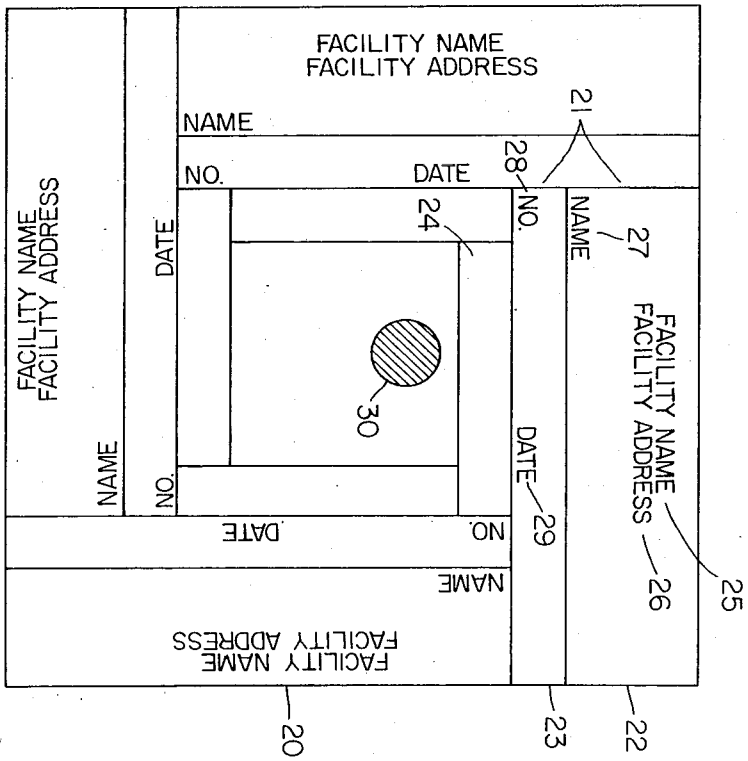
FIG. 2 is a full sized card of the Four Sided Flash Card type which is an embodiment of the present invention.

With reference to FIG. 1 of the drawings an index card is represented by number 10 with the dimensions of 127 mm wide and 77 mm in height. Contained within it is a boxed area numbered 11 which contains the facility name, address, patient name, number of the x-ray and date information. The outside edge of the box 11 is 27 mm from the outside edge of the index card. The box itself is 72 mm wide and 26 mm deep. Contained within this larger box is a smaller box area roughly in the form of a rectangle which is designated by the number 12. This box is contained in the upper portions of the larger box rectangle 11. In box number 12 there is the facility name, facility address and name of the patient. The dimensions of area 12 are 72 mm wide and 19 mm high. Under this in area 11 is a relatively long rectangular area number 13 which is again 72 mm long and 7 mm high which contains an area for the serial number of the x-ray and the date of the x-ray. Please note that in addition 14 refers to the facility name or could be the doctors name, 15 refers to the address of the facility or the doctor and number 16 refers to the name of the patient which would be recorded (as would all the information) with a soft graphite marking pencil, 17 refers to the area of the card where the ongoing serial number of the x-ray is recorded. For example if the facility had taken 1117 x-rays to date and this were the next x-ray to be taken the number 1118 would be recorded so that a master list of x-rays and there numbers as provided by law is kept by the doctor of facility. Lastly number 18 refers to an area for the date. Please note that FIG. I is the traditional, presently used type of index flash card which has an area on one side only for imprintation on the x-ray film. FIG. 2 is the embodiment of the present invention. Number 20 refers to a square card which is 100 mm square on each side. Contained within on each side are four boxes similar to 21 of FIG. I which are 73 mm wide and 27 mm high and which contains the facility or doctor's name, facilities' address, the patient's name, serial number of the x-ray and the date. In a likewise fashion to FIG. I, 22 is a rectangular area within 21 which is 73 mm long, and 15 mm high which contains the facility name, address and the patients name. Beneath that is an area 23 which is contained within area 21 which provides a space for the serial number of the x-ray and the date. Unlike FIG. I there is an area in FIG. II, number 24, in which the doctor may record additional information concerning the particular patient or x-ray exposure settings directly under the other patient information contained in area 21. 25 refers to the doctor or facility name, 26 refers to doctor or facility address, 27 refers to the patient name, 28 refers to the serial number of the x-ray, and 29 refers to the date of the x-ray. In addition 30 is an eccentrically placed hole which measures 9 mm in diameter and is used for purposes of stacking these cards on a rod perpendicular to the wall surface to aid in ease of handling and storage. Due to the holes off centered nature the weight of the card below the hole when stacked on a perpendicular wall rod pulls each card into a similar position for easy stacking and boxing.

The card is composed of high quality paper such as an Aquabee #804, 100% rag smooth drawing paper, heavy weight. This is a 70 pound paper of moderate thickness. This paper has very little rough rag fiber and so being fairly light weight it allows for the transmission of light. Because there is very little rough rag content, when light is passed through the x-ray card the information that is imprinted on the card is also imprinted on the x-ray film with very little residue or artifacts on the x-ray film from rough rag content that might be in the paper. The card is utilized by placing it onto a flash box that has a window which aligns with the imprinted box on the index card. Then an x-ray film is put on top of that in an area of the x-ray film which has been blocked from x-rays so that it has not been exposed. Then the light box device is flashed so that light passes through the x-ray marking card to the x-ray film. Prior to flashing the x-ray the doctor has entered with a graphite pencil, of a soft lead consistance, the name, serial number and date of the x-ray study and this information along with the pre-printed name of the facility and doctor's name is permanently imprinted by flash system on to the x-ray. Because the graphite print is heavy enough to block light transmission (as does the inked pre-printed information) the information to be recorded on the x-ray appears as white non-exposed print or script. My development of the four sided flash card marked FIG. II on the drawing enables four such patient names, numbers and data, etc. to be placed on each card as there are four stations, one on each side of the card for this type of information. Therefore, by rotating the four sided flash card, number 20, 90°, new information may be entered and another x-ray may be flashed. This is efficient both in time and cost.

I claim:

1. A rectangular card for flash-marking exposed film: said card having a first preprinted area at one edge thereof; said area comprising first and second indentification indicia for indentifying the film; said first indicia being of a general nature; said second indicia designating at least one/blank space for receiving specific information related to the subject matter recorded on the film; wherein the improvement comprises at least one additional preprinted area at another edge of said card, said at least one additional area being a duplicate of said first area whereby said card may be reused.

2. The card of claim 1 wherein an opening is provided through the central area of said card.

3. The card of claim 2 wherein the opening is offset from the geometric center of the rectangular card.

4. The card of claim 1 wherein each edge of said card has an identical preprinted area thereon.

5. The card of claim 1 wherein the card is made of paper having a high rag content.

6. The card of claim 5 wherein the card is made from 70 pound paper.

* * * * *